US007415911B2

(12) United States Patent
Cole

(10) Patent No.: US 7,415,911 B2
(45) Date of Patent: Aug. 26, 2008

(54) ADJUSTABLE TOOLS

(76) Inventor: Charles A. Cole, deceased, late of Plano TX (US); by Melissa Cole, legal representative, 7620 Avalon Dr., Plano, TX (US) 75025

( * ) Notice: Subject to any disclaimer, the term of this patent is extended or adjusted under 35 U.S.C. 154(b) by 153 days.

(21) Appl. No.: 11/434,701

(22) Filed: May 16, 2006

(65) Prior Publication Data

US 2006/0260445 A1 Nov. 23, 2006

Related U.S. Application Data

(60) Provisional application No. 60/682,255, filed on May 18, 2005.

(51) Int. Cl.
*B25B 23/16* (2006.01)

(52) U.S. Cl. ..... 81/177.8; 81/177.6; 81/177.7

(58) Field of Classification Search ..... 81/177.8, 81/177.6, 177.7
See application file for complete search history.

(56) References Cited

U.S. PATENT DOCUMENTS 7,156,003 B2 * 1/2007 Cole ..... 81/177.8
7,171,876 B2 * 2/2007 Chen ..... 81/177.8

* cited by examiner

*Primary Examiner*—Joseph J. Hail, III
*Assistant Examiner*—Shantese McDonald
(74) *Attorney, Agent, or Firm*—Michael Cameron, Esq.

(57) ABSTRACT

Adjustable tools which may be linked through a coupling so that the tool and the handle are rotatable relative to each other in a released condition and locked relative to each other in a locked position. The tool and the handle may thus be adjusted to have the tool at any desired orientation to the handle and in a locked position in that orientation.

13 Claims, 5 Drawing Sheets

ADJUSTABLE TOOLS

RELATED CASES

This application is entitled to and hereby claims the benefit of the filing date of Provisional Application Ser. No. 60/682,255 entitled "Adjustable Tools: filed May 18, 2005 by Charles A. Cole.

FIELD OF THE INVENTION

The present invention relates to adjustable tools, which may be linked through a coupling so that the tool and the handle are rotatable relative to each other in a released condition and locked relative to each other in a locked position. The tool and the handle may thus be adjusted to have the tool at any desired orientation to the handle and in a locked position in that orientation.

BACKGROUND OF THE INVENTION

Many tools have been proposed which provide for adjustable wrenches. One such tool is shown in U.S. Pat. No. 5,419,221 issued May 30, 1995 to James Cole. This patent discloses a wrench which has a splined pin fixed to the head of the wrench with the handle being moveable between an upper released position and a lower locked position. This wrench has the disadvantage that the pin protrudes for a substantial distance above the wrench in all instances. This patent is hereby incorporated in its entirety by reference.

U.S. Pat. No. 5,775,184 issued Jul. 7, 1998 to James Cole discloses a similar wrench. U.S. Pat. Nos. 5,820,288, 6,000,299 and 6,161,982 also relate to tools which use splined connections in various ways. These patents are further incorporated in their entirety by reference.

Other variations have been proposed which require a smooth pin positioned on the wrench head with the pin being used to engage an opening in the handle which includes flat surfaces moveable into engagement at various positions to lock the wrench and the handle into fixed positions. These wrenches also require that the pin protrude a substantial distance above the top of the wrench.

All of these wrenches are subject to certain shortcomings. Many of the wrenches previously developed to have releasable coupling involve the use of springs so that the wrench may be released only while the pin is held in a particular position from which it returns when released. This results in certain disadvantages, particularly with respect to the protrusion of elements from the sides or tops of the wrenches or the tools. Accordingly, a continued effort has been directed to the development of simpler, more rugged and less protrusive coupling systems for tools.

SUMMARY OF THE INVENTION

According to the present invention, an adjustable tool is provided having a handle joined to a tool member by a coupling comprising a pin positioned through a receptacle on the handle and a receptacle on the tool member so that the handle and the tool member are releasable by disengagement of the pin so that each of the handle and tool member are rotatable relative to the other and so that when the handle and tool are engaged by engagement of the pin the handle and tool are locked in position, each relative to the other, the coupling comprising: a first and a second receptacle positioned in a first member, the first member having a first and a second end and comprising a first extension and a second extension on the first end of the first member with each of the extensions having first and second coaxial receptacle openings each having an inside and an outside circumference and being positioned through each receptacle, the receptacle openings each having a row of splines positioned around its inside circumference; a third receptacle having an inside circumference and having a first and a second bevel around outer edges of its inside circumference and splines in the central portion of its inside circumference and positioned in a second end of a second member, the third receptacle, in the second end of the second member being formed to fit between the first and second extensions so that the third receptacle is coaxial with the first and second receptacle openings; a pin, the pin having a first end and a second end and an outside, a first row of splines positioned around the outside of the pin on its first end, a first space slightly wider than the first row of splines around the outside of the pin and adjacent the first row of splines, a second row of splines wider than the first row of splines positioned around the outside of the pin and adjacent the first space, a second space positioned around the pin adjacent the second row of splines; first and second ball bearings positioned in openings in the pin in the second row of splines, the ball bearings being positioned in the openings with springs biasing the ball bearings outwardly so that when the first ball bearing is moved outwardly into the first bevel the pin allows the first and second members to rotate relative to each other and so that when the second ball bearing is moved outwardly into the second bevel the first and second member are locked into position relative to each other; and, a first and second end cap positioned on the first and second ends of the pin respectively.

BRIEF DESCRIPTION OF THE DRAWINGS

FIG. 1(*a*) schematically shows a representative ratchet wrench head;

FIG. 3(*a*) is an end view of a first end of the pin of FIG. 3;

FIG. 3(*b*) is an end view of a second end of the pin shown in FIG. 3;

FIG. 3(*c*) is a cross-sectional view of an end cap suitable for use on either end of the pin shown in FIG. 3;

DESCRIPTION OF PREFERRED EMBODIMENTS

In the discussion of the Figures, the same numbers will be used throughout to refer to the same or similar components.

Figure 1:
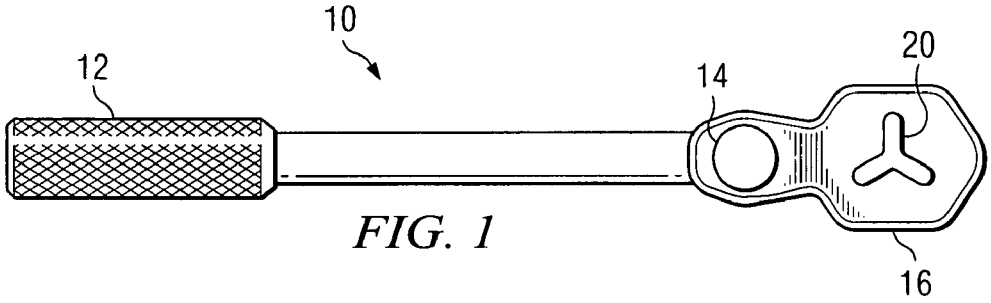
FIG. 1 schematically shows a ratchet wrench, including a coupling according to the present invention.
Figure 1A:
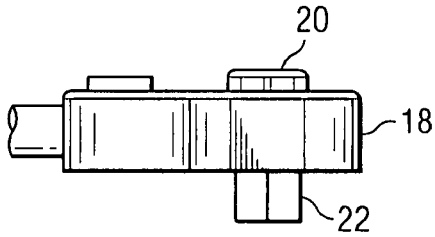

In FIG. 1 an adjustable wrench, according to the present invention, is shown. The wrench comprises a handle 12 having a coupling 14 between the handle and a ratchet 16 and having a ratchet head 18. A selector 20 is positioned on top of the ratchet, as well known to those skilled in the art.

In FIG. 1(*a*) a more detailed showing of the ratchet head is illustrated, particularly showing a mating shaft 22 for engagement with a tool, as well known to the art.

Figure 2:
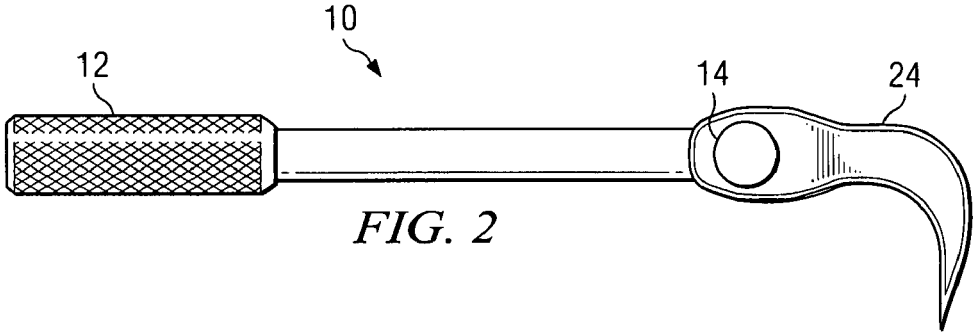
FIG. 2 shows an adjustable tool comprising a handle connected to a pry bar.

In FIG. 2 a similar device is shown except that the tool connected to the handle by the coupling 14 is a pry bar 24.

Figure 3:
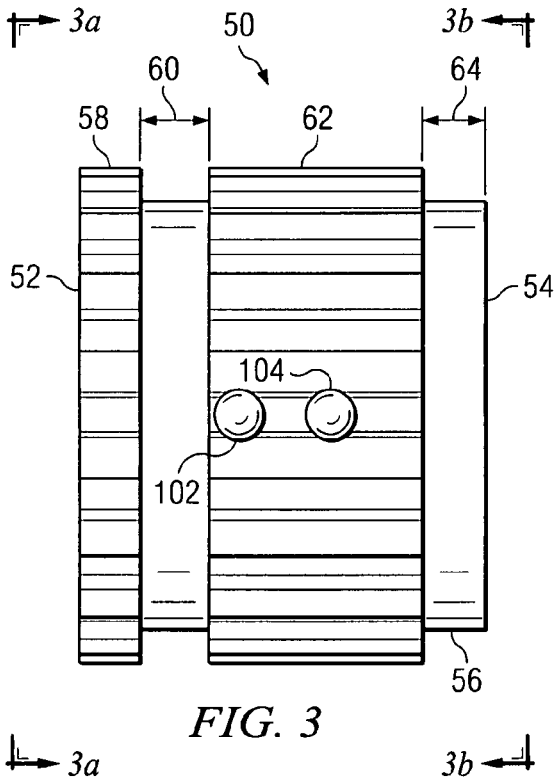
FIG. 3 is a schematic diagram of a pin, according to the present invention.
Figure 3A:
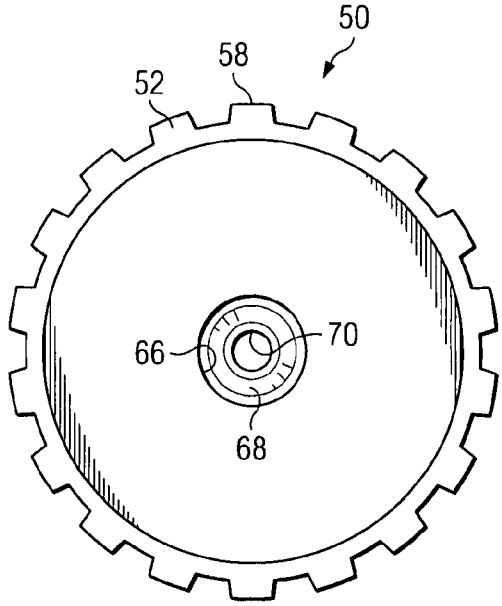
Figure 3B:
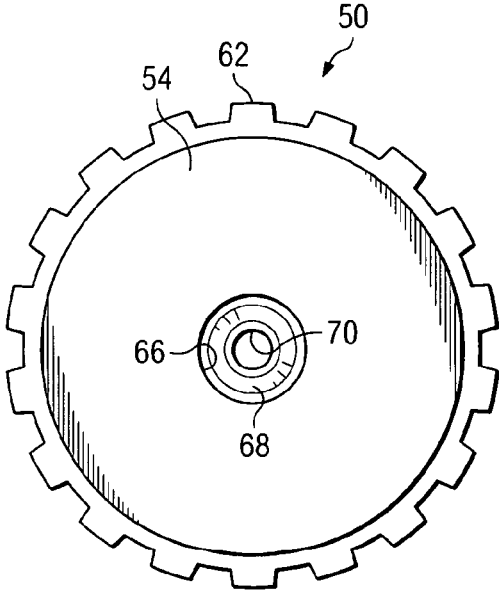
Figure 3C:
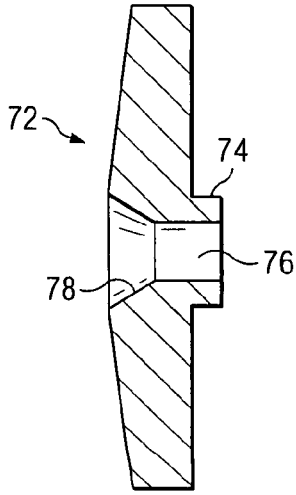

In FIG. 3 a pin useful in the adjustable tool of the present invention is shown. The pin comprises a pin 50 having a first end 52, a second end 54 and an outside 56. The pin also includes on its first end 52 on its outside, a first row 58 of splines. A first space 60 slightly wider than the first row 58 of splines is positioned next to the first row of splines. A second row of splines 62 is somewhat wider and is positioned adjacent to first space 60. A second space 64 is positioned adjacent to the edge of second row of splines 64 and adjacent to second end 54. The pin also includes two ball bearings 104 and 106, which in the assembled wrench are positioned in holes in the second row of splines and maintained in an outwardly biased position by springs positioned beneath the ball bearings in the holes, as known to the art. Desirably the holes are positioned in valleys between splines. First end 52 is shown as including a first row of splines 58 on its outside and on it's inside a recess 66, a bevel 68 and a screw receptacle 70.

In FIG. 3(*b*) an end view of second end 54 is shown and is similar to the end view of first end 52, except that the splines on the outside are the outside of the second row of splines 62.

End caps are typically used with the pin, with end caps being shown in FIG. 3(*c*). An end cap includes a protrusion 74, which mates with recess 66 and is formed for connection to the first and second ends by a screw (not shown) which is seated in a bevel 78 and positioned through a screw opening 76 into screw receptacle 70.

Figure 4:
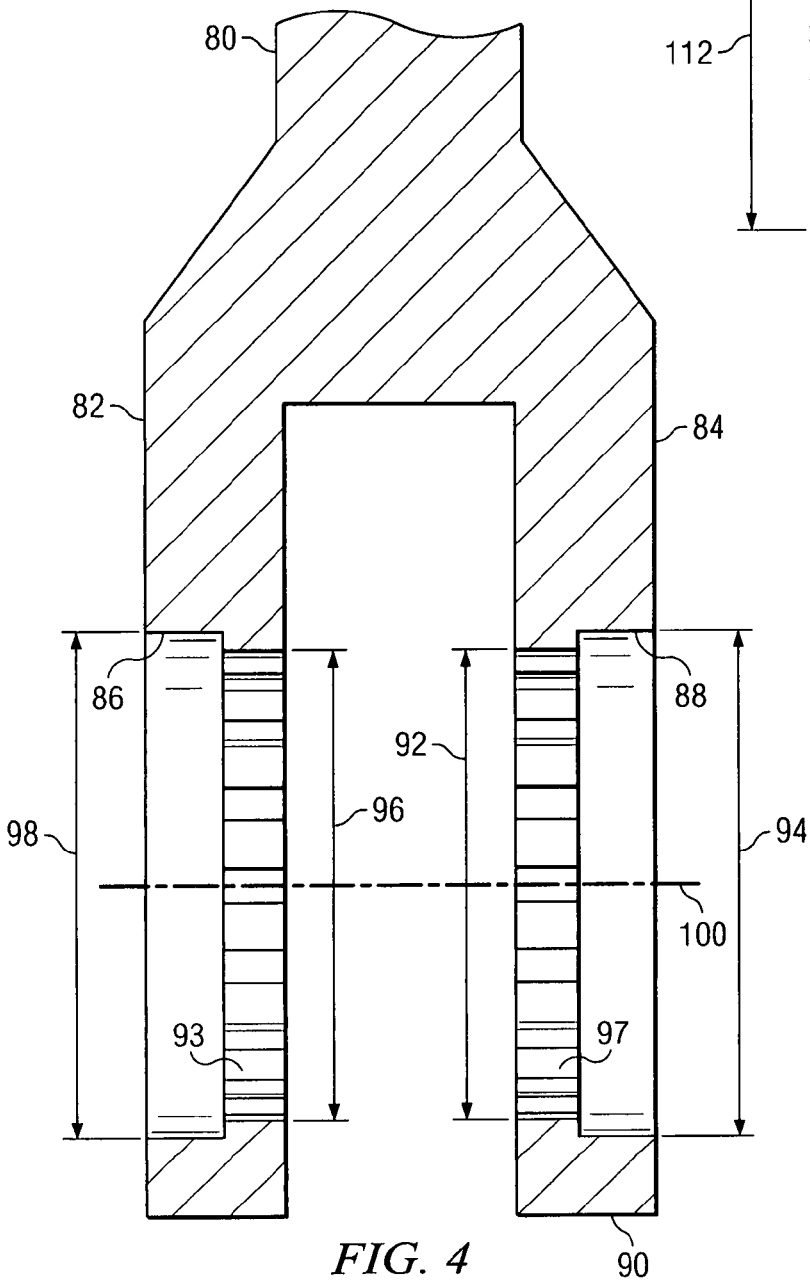
FIG. 4 is a schematic cross-sectional diagram of a first member for connection at a coupling of the present invention.

In FIG. 4 a first member 80 is shown and includes a first extension 82 and a second extension 84. These extensions are spaced to receive, between the extensions a second member 106. First member 80 includes first extension 82, including a first receptacle 86 and second extension 84, including a second receptacle 88. The receptacles are located in a first end 90 of the first member. First receptacle 86 has an inside circumference 92 with a first receptacle row of splines 93 being located on inside circumference 92. Outside circumference 94 of receptacle 86 is as shown. A second receptacle row of splines 97 is positioned on an inside circumference 96 of second receptacle 88. The receptacles have a common axis 100.

Figure 5:
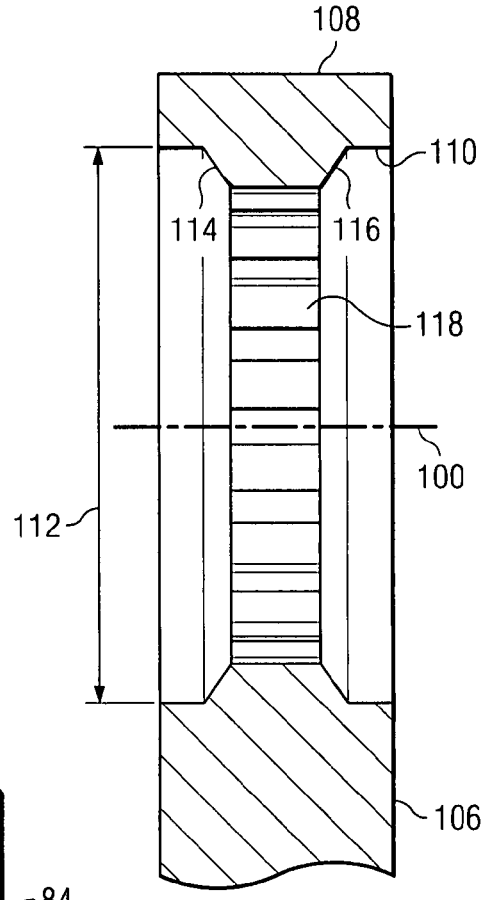
FIG. 5 is a schematic diagram of a mating member for junction to the member shown in FIG. 4.

In FIG. 5 a second member 106 is included and is adapted to matingly engage first member 80. A second end of second member 108 includes a third receptacle 110, which has an inside circumference 112 and includes a first and a second bevel 114 and 116, respectively around its outer circumference on both sides of the third receptacle. Splines 118 are positioned on the middle portion of the circumference of third receptacle 110. When the coupling is formed, these members are positioned with the second end 108 of second member positioned with third receptacle 108 positioned coaxially with first and second receptacles 86 and 88.

Figure 6:
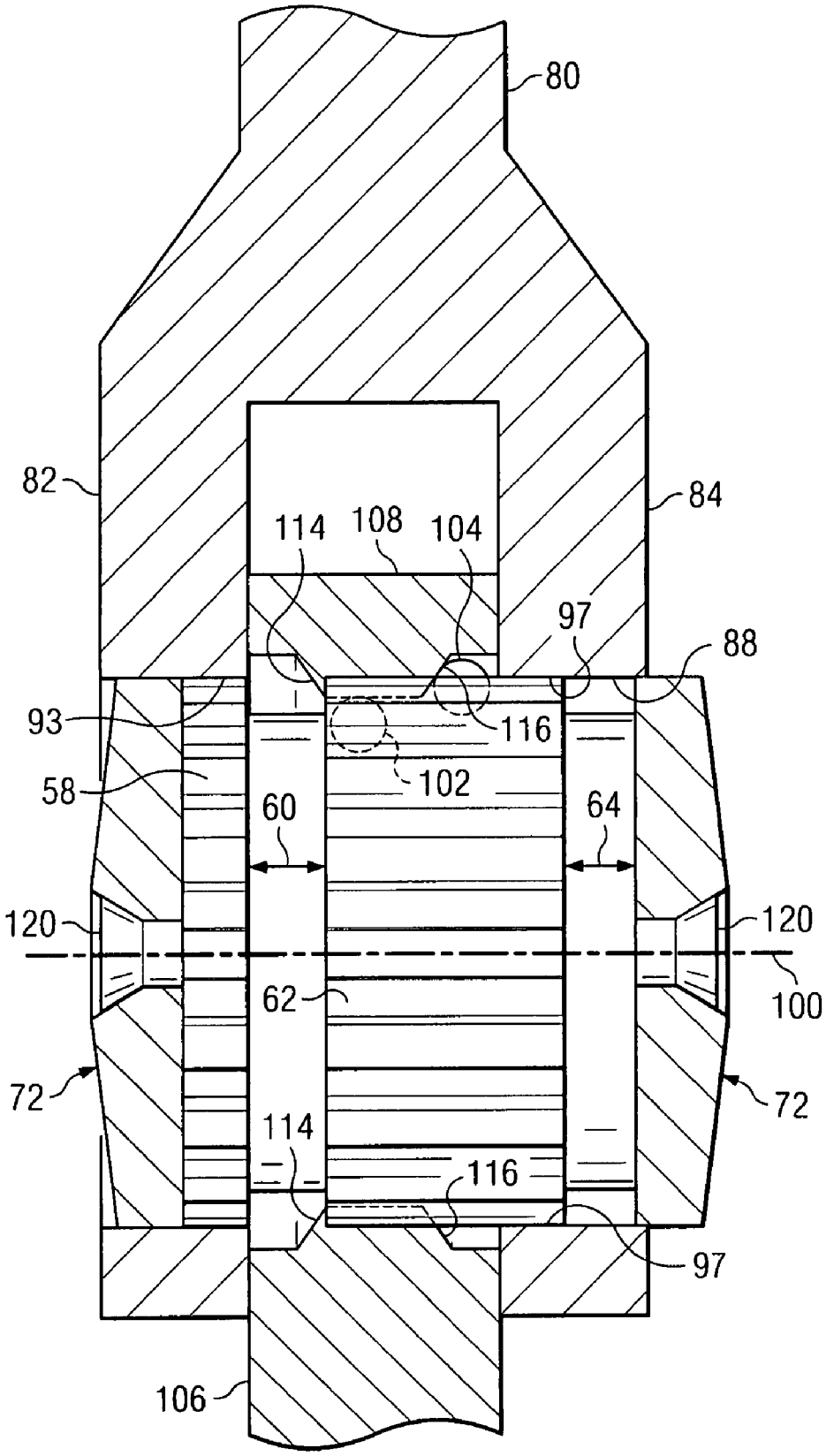
FIG. 6 is a schematic diagram of the members shown in FIGS. 4 and 5 in combination with the pin in place in a locked position ; and, FIG. 7 is a schematic diagram of the members of FIGS. 4 and 5 in combination with the pin in a released position.
Figure 7:
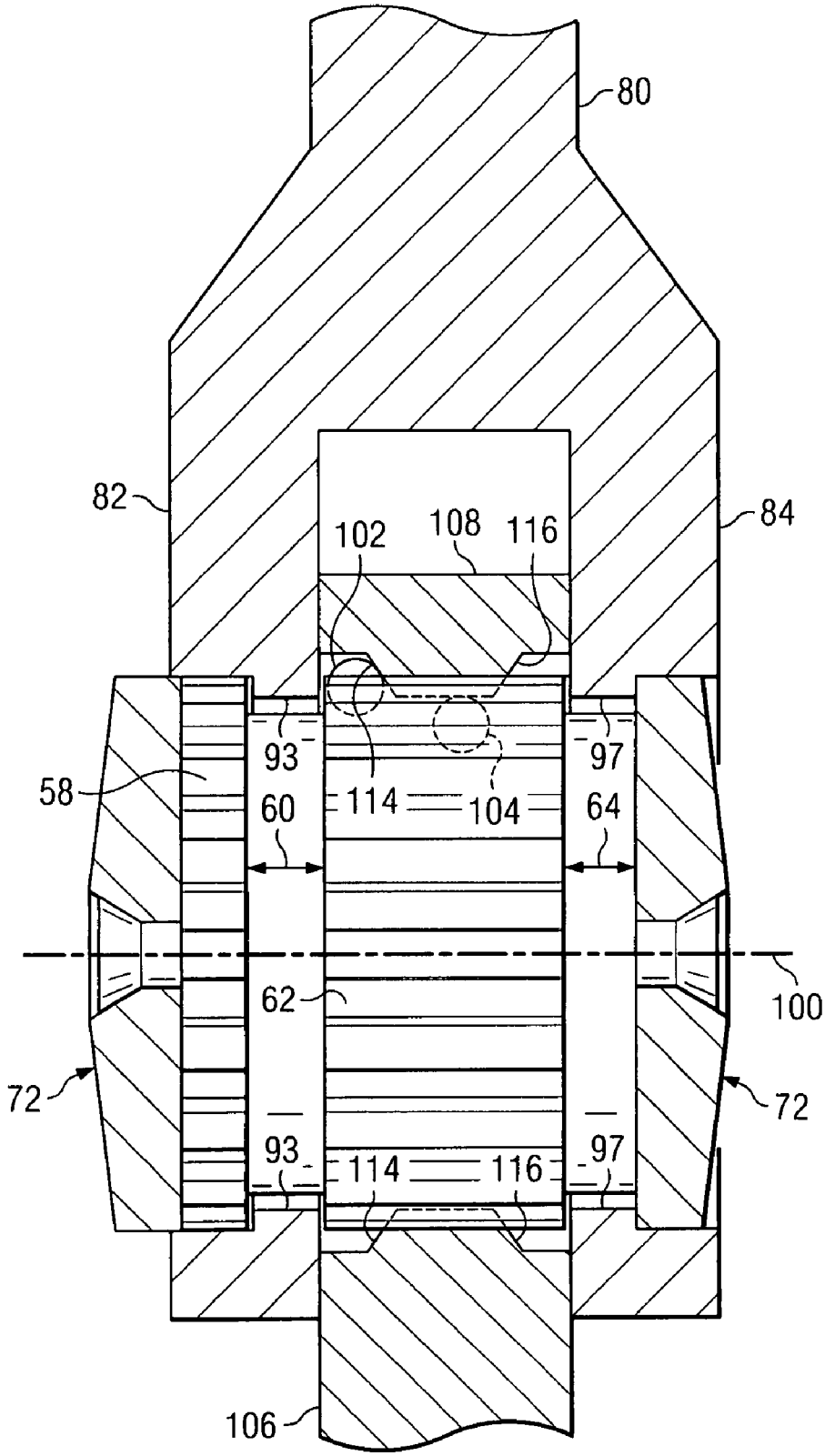

In FIG. 6 a pin, as previously described, is positioned through receptacles 86 and 88 and third receptacle 110. As shown in FIG. 6 ball bearing 104 is positioned in an outwardly extended position from second row of splines 62 in bevel 116. In this position, first receptacle row of splines 93 and second receptacle row of splines 97 are positioned in engagement with first row of splines 58 and second row of splines 62 on the pin. This ball bearing, which is desirably extended from about 50 to about 65 percent of its diameter outwardly from the receptacle in which it is positioned in the pin as now positioned in bevel 116 maintains the pin in this position. To change this positioning, the pin may be pushed through the receptacle until ball bearing 102 is positioned in bevel 114 in which position splined rows 93 and 97 are located in first space 60 and second space 64, as shown in FIG. 7. In this position, the wrench is released and the members can be rotated relative to each other. It will be noted that there is no significant protrusion of either of the sides of the pin from the outside of member 80. This pin arrangement does not require any springs for its operation.

Desirably the ball bearings are about 0.063 inches in diameter, although other sizes could be used, especially if larger pins are desired. Typically, the first row of splines 58 is approximately 0.063 inches in width with first space 60 being slightly wider so that splines 58 can rotate freely in space 60. Second space 64 is also of approximately the same diameter. Typically the ball bearings are positioned about 0.063 inches apart so that the rows of splines are readily moved from engagement into the bevels by simply pushing the pin through the coupling.

By the use of the adjustable tool of the present invention, there are no protruding members above or below the coupling and the coupling can be used in either a horizontal or a vertical position on a wrench or tool. As shown in FIG. 1 and FIG. 2, the coupling is clearly horizontal as positioned on the tool in FIG. 1 and is clearly vertical as positioned in the tool shown in FIG. 2.

In the embodiments shown in FIGS. 6 and 7, the ends are retained in position by screws 120. As also shown in FIGS. 1 and 2 the pin receptacles and all other receptacles are coaxially positioned. This connection is a very effective connection and is readily used to produce tools of any desired type. In other words, a handle can be attached to either the first or second member. Similarly a tool can be attached to either the first or the second member. It is immaterial whether the tool is attached to the member having the two receptacles or whether it is attached to member 106, which has a single shaft.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. An adjustable tool having a handle joined to a tool member by a coupling comprising a pin positioned through a receptacle on the handle and a receptacle on the tool member so that the handle and the tool member are releasable by disengagement of the pin so that each of the handle and tool member are rotatable relative to the other and so that when the handle and tool are engaged by engagement of the pin the handle and tool are locked in position, each relative to the other, the coupling comprising:

a) a first and a second receptacle positioned in a first member, the first member having a first and a second end and comprising a first extension and a second extension on the first end of the first member with each of the extensions having first and second coaxial receptacle openings each having an inside and an outside circumference and being positioned through each receptacle, the receptacle openings each having a row of splines positioned around its inside circumference;

b) a third receptacle having an inside circumference and having a first and a second bevel around outer edges of its inside circumference and splines in the central portion of its inside circumference and positioned in a second end of a second member, the third receptacle, the second end of the second member being formed to fit between the first and second extension so that the third receptacle is coaxial with the first and second receptacle openings;

c) a pin, the pin having a first end and a second end and an outside, a first row of splines positioned around the outside of the pin on its first end, a first space slightly wider than the first row of splines around the outside of the pin and adjacent the first row of splines, a second row of splines wider than the first row of splines positioned around the outside of the pin and adjacent the first space, a second space positioned around the pin adjacent the second row of splines;

d) first and second ball bearings positioned in openings in the pin in the second row of splines, the ball hearings being positioned in the openings with springs biasing the ball bearings outwardly so that when the first ball bearing is moved outwardly into the first bevel the pin allows the first and second members to rotate relative to each other and so that when the second ball bearing is moved outwardly into the second bevel the first and second member are locked into position relative to each other; and, e) a first and second end cap positioned on the first and second ends of the pin respectively.

2. The adjustable tool of claim 1 wherein the first member is connected to a handle and the second member is connected to a tool.

3. The adjustable tool of claim 1 wherein first member is connected to a tool and the second member is connected to a handle.

4. The adjustable tool of claim 1 wherein the adjustable tool comprises a wrench.

5. The adjustable tool of claim 1 wherein the tool is a ratchet wrench.

6. The adjustable tool of claim 1 wherein the tool is a pry bar.

7. The adjustable tool of claim 1 wherein the ball bearings are spaced apart at a distance equal to the width of the first space.

8. The adjustable tool of claim 1 wherein the rows of splines positioned around the inside circumferences of the receptacles are positioned in the first and second bevel space when the adjustable tool is in a disengaged configuration.

9. The adjustable tool of claim 1 wherein the splines on the inside circumferences of the receptacles are positioned in engagement with the first row of spines and the second row of splines when the adjustable tool is in a locked position.

10. The adjustable tool of claim 1 wherein the pin includes a first end cap on the first end of the pin and a second end capon the second end of the pin.

11. The adjustable tool of claim 1 wherein the tool is lockable by pushing the pin from a locked to a disengaged position.

12. The adjustable tool of claim 1 wherein the tool is lockable by pushing the pin from a disengaged to a locked position.

13. The adjustable tool of claim 1 wherein the pin has a very slight protrusion from the coupling.

* * * * *